United States Patent [19]

Frink et al.

[11] 4,328,403

[45] May 4, 1982

[54] SINGLE BARREL PUFFER CIRCUIT INTERRUPTER

[75] Inventors: Russell E. Frink, Port Orchard, Wash.; Stanislaw A. Milianowicz, Monroeville, Pa.

[73] Assignee: Westinghouse Electric Corp., Pittsburgh, Pa.

[21] Appl. No.: 63,014

[22] Filed: Aug. 2, 1979

Related U.S. Application Data

[63] Continuation of Ser. No. 769,140, Feb. 15, 1977.

[51] Int. Cl.[3] ..... H01H 33/88

[52] U.S. Cl. ..... 200/148 A

[58] Field of Search ..... 200/148 A, 150 G, 148 R

[56] References Cited

U.S. PATENT DOCUMENTS

| | | | |
|---|---|---|---|
| 3,659,065 | 4/1972 | Roidt et al. | 200/148 A |
| 3,739,125 | 6/1973 | Noeske | 200/148 A |
| 3,839,613 | 10/1974 | Tsubaki et al. | 200/148 A |
| 3,852,551 | 12/1974 | Cleaveland | 200/148 A |
| 3,946,183 | 3/1976 | Milianowicz | 200/148 A |
| 3,975,602 | 8/1976 | Hertz et al. | 200/148 A |
| 4,048,456 | 9/1977 | Noeske | 200/148 A |

*Primary Examiner*—Robert S. Macon

*Attorney, Agent, or Firm*—M. J. Moran

[57] ABSTRACT

A single barrel puffer circuit interrupter is taught. The single barrel accomplishes the multiple purposes of electrical insulation between terminals, basic support and puffer gas containment. The circuit interrupter has a movable nozzle-piston arrangement fixedly attached to a movable cylindrical hollow arcing contact. The nozzle slidably engages a second cylindrical, hollow arcing contact and is disposed in slidable but sealed relationship therewith at all times, thus providing a shield between the arcing contact and the barrel of the circuit interrupter. In addition, one of the arcing contacts overlaps the other in telescoping relationship when the contacts are closed. This provides a lost motion feature for the puffer. The lost motion feature allows the puffer gas to be compressed for a short period of time by the piston during a contact opening operation in a completely enclosed region before the gas is provided to the region of an electric arc between the opening contacts.

6 Claims, 2 Drawing Figures

SINGLE BARREL PUFFER CIRCUIT INTERRUPTER

CROSS REFERENCE TO RELATED APPLICATIONS

This is a continuation of application Ser. No. 769,140 filed Feb. 15, 1977.

This invention is related to those disclosed in copending, concurrently filed applications Ser. No. 768,939 and Ser. No. 769,139.

BACKGROUND OF THE INVENTION

1. Field of the Invention

The subject matter of this invention relates generally to puffer circuit interrupters, and relates more particularly to single barrel circuit interrupters with protective nozzles.

2. Description of the Prior Art

It has been known for some time to utilize gaseous environments in circuit breaker apparatus. U.S. Pat. No. 2,757,261 issued to Lingal et al. on July 31, 1956, U.S. Pat. No. 2,798,922 issued to Lingal et al. on July 9, 1957, U.S. Pat. No. 2,809,259 issued to Baker et al. on Oct. 8, 1957 and U.S. Pat. No. 2,733,316 issued to Browne et al. on Jan. 31, 1956 all teach sulfur hexafluoride gas environments for circuit breaker apparatus. The preceding patents teach a relatively static gaseous enviroment in which the insulating and arc extinguishing qualities of sulfur hexafluoride gas are utilized. U.S. Pat. No. 2,824,937 issued to A. P. Strom on Feb. 25, 1958 and U.S. Pat. No. 2,748,226 issued to MacNeill et al. on May 29, 1956 teach the utilization of a blast or flow of sulfur hexafluoride gas for extinguishing an arc. Recently, puffer type compressed gas circuit interrupters have been taught, such as by U.S. Pat. No. 3,852,551 issued Dec. 3, 1974 to C. M. Cleaveland. In the latter case, a piston is mounted internally to an elongated circuit breaker apparatus to operate in conjunction with the operating mechanism for the contacts of the circuit breaker apparatus to provide a puff or jet of gas to the region of the arc during the contact opening operation of the circuit breaker. In the prior art as known, the gas is statically maintained inside the circuit breaker apparatus, or the gas is provided as an external blast of gas from externally stored gas reservoirs or the gas is supplied as part of a two-barrel, piston operated gas puffer. In the latter case, the external barrel provides insulation and support between the terminals of the circuit breaker and the internal barrel provides a separated gas reservoir where gas pressure may be built up during the opening operation of the circuit breaker. A single barrel gas blast circuit interrupter with piston and nozzle arrangement is known but shielding of the arc region and lost motion pressurization therewith is apparently not known. It would be advantageous if there was apparatus in which a single external barrel could be used in conjunction with a piston and nozzle puffer type circuit breaker apparatus where enhanced arc shielding and increased gas pressurization were utilized.

SUMMARY OF THE INVENTION

In accordance with the invention, puffer circuit breaker apparatus is taught which includes a single, elongated cylindrical barrel upon which electrical terminals are disposed in electrically contacting relationship with internal separable contacts. The barrel is generally sealed to the outside environment relative to the internal portion thereof. Two cylindrical hollow conductors are provided, one of which is fixed and the other of which is movable in conjunction with an operating mechanism. Disposed upon the movable contact is a combination nozzle and piston arrangement where the piston is disposed in a movable sealed relationship with the inner wall of the previously described single barrel. That end of the nozzle which is not attached to the movable contact moves in slidable sealed relationship with the second hollow fixed contact, thus maintaining a shield between the contacts and the inner wall of the single barrel. Furthermore, the first contact is of relatively larger diameter than the second contact and thus telescopes over the second contact in the contact closed disposition. Consequently, when the contacts are opened by moving the second contact away from the first contact, the overlapping region acts in conjunction with the moving piston to compress the sulfur hexafluoride gas for a relatively short period of time before the contacts move apart to provide a vigorous stream of gas to the contact region immediately after the contacts come open to extinguish, cool and otherwise affect the arc which is likely to exist between the contacts as the circuit breaker opens.

BRIEF DESCRIPTION OF THE DRAWINGS

For a better understanding of the invention, reference may be had to the preferred embodiments thereof shown in the accompanying drawings, in which.

DESCRIPTION OF THE PREFERRED EMBODIMENTS

Figure 1:
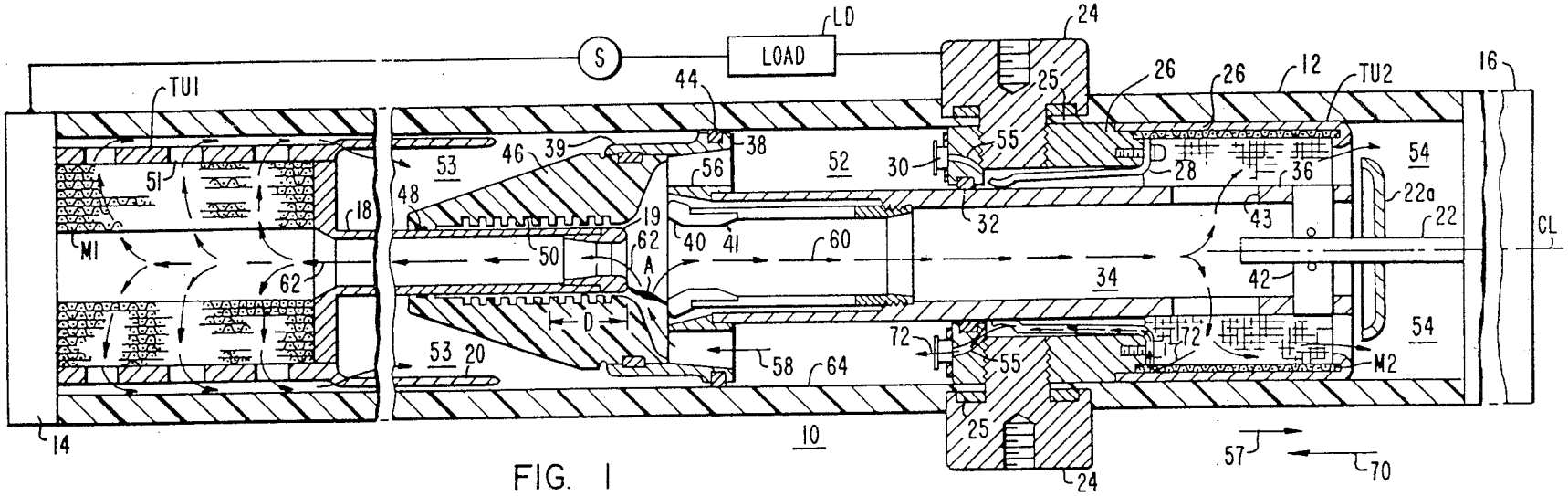
FIG. 1 shows a puffer circuit breaker apparatus partially in section, partially broken away, and partially in block diagram form; and, FIG. 2 shows a broken away section of a portion of the interior wall of the support and insulating cylinder for the circuit breaker apparatus of FIG. 1.

Referring now to the drawings and FIG. 1 in particular, a single tube puffer circuit interrupter 10 is shown. The puffer circuit interrupter or circuit breaker 10 may include a hollow cylindrical insulating support tube 12, the purpose of which will be described in more detail hereinafter. Support tube 12 has an electrically conducting terminal 14 on the left portion thereof and has an operating mechanism 16 on the right portion thereof as viewed in FIG. 1. The insulating support tube 12 may be radially symmetrical about a centerline CL. A hollow, generally cylindrical electrical conductor 18 is shown in the left portion of circuit breaker apparatus 10. The hollow conductor 18 is interconnected electrically with the terminal 14 through a conducting cooler tube TU1, the purpose of which will be described in detail hereinafter. At the right end of the hollow electrical conductor 18 is an arcing contact piece 19 which may comprise any suitable electrically conductive material which will withstand repeated arcing for a relatively long period of time for many operations. Flexible main conducting fingers 20 are also connected to terminal 14 by way of cooler tube TU1. Interconnected with the operating mechanism 16, shown schematically to the right of FIG. 1, is a movable connecting rod 22, the use of which will be described more fully hereinafter. Disposed on either side (top and bottom as viewed in FIG. 1) of the electrically insulating support tube 12 may be electrically conductive terminals 24. Each electrically conductive terminal 24 may be seated and sealed in an appropriate groove or seat 25 in the insulating support member 12. A portion of the electrically conductive terminal 24 protrudes through the insulating support tube 12 and is threaded into an internal connector and support piece 26 for securing the terminal 24 against the inside wall of the insulating support tube 12 in electrically conducting relationship with the internal conductor 26. Disposed on the internal conducting member 26 may be a plurality of electrically conducting flexible fingers 28 and at least one unidirectional gas valve 30. The use of the latter two elements will be described more fully hereinafter. Also disposed on the internal conducting member 26 may be a neoprene seal 32 or the like. The use of the neoprene seal 32 will be described more fully hereinafter with respect to other portions of the apparatus. A cooler tube TU2 is interlocked against the inside wall of the support tube 12 at 26*a* on the support piece 26. The use of tube 12 will be described more fully hereinafter.

There is provided a movable electrical contact assembly 34 which includes a generally cylindrical hollow electrically conducting tube member 36. The electrically conducting tube member 36 may be radially disposed symmetrically about the previously-described centerline CL. Disposed at the left end of the electrically conducting movable tube member 36 is a conducting flange 38 having an extended electrically conducting portion 39 which is adapted to make sliding electrical contact with the previously described main contact fingers 20 when the puffer circuit breaker 10 is closed. Also disposed on the left portion of the hollow conductive tube member 36 may be flexible contact fingers 40 which are complementary to the contact piece 19 described previously. On the right portion of the electrically conducting hollow cylindrical tube 36 is disposed a yoke 42 which is mechanically interconnected with the connecting rod 22 such that movement of the connecting rod 22 in the direction 70 in response to an appropriate action in the operating mechanism 16 will cause the entire body of the hollow conducting tube member 36 to move to the left to thus place the arcing contact fingers 40 in a disposition of overlapping electrical contact with the arcing contact 19 and to place the extended portion 39 of the conducting flange 38 in a disposition of electrical contact with the main contact fingers 20. It is to be noted that in this particular embodiment of the invention the relative longitudinal disposition of the contact fingers 20, the extended portion 39, the contact piece 19, and the contact fingers 40 is such that electrical contact is made during a circuit breaker closing operation between the contact piece 19 and the contact fingers 40 before electrical contact is made between the contact fingers 20 and the extended portion 39. Likewise, in an opening operation, the contact fingers 20 and the extended portion 39 separate before the contact piece 19 and the contact fingers 40 separate. The amount of overlap between fingers 40 and contact 19 is represented by D. The fingers 40 are joined at region 41 so that the inner regions of tubes 18 and 36 are sealed off from chamber 52 when the circuit breaker 10 is in the closed state. There is provided a neoprene seal 44 on the outer portion of the contact flange 38. The seal operates against the inner surface of the insulating support tube 12 to thus locally isolate two gas pressure regions which will be described hereinafter. In a like manner, the previously described seal 32 operates against the hollow conducting tube 36 to locally isolate one of the previously described gas pressure regions from a third gas pressure region.

There may be disposed to the right of the electrically conducting cylinder 36 an opening 43 which provides communication between the internal portion of the hollow conducting tube 36 and the region surrounding the external portion of the hollow conducting tube member 36 to the right of the seal 32.

There is provided an arc nozzle 46, the right portion of which is disposed on the previously described conducting flange 38. Nozzle 46 is supported at the left portion thereof in sealed but movable relationship against the outer surface of the previously described hollow conductor 18. The seal 48 cooperates with the previously described seal 44 to provide the first two previously described regions of different gas pressure during the operation of the circuit interrupter apparatus 10. In a preferred embodiment of the invention, nozzle 46 always remains in sealed relationship with tube 18 thus providing an arc shield between the arcing contacts 19 and 40 and the inner surface of wall 12 during an arcing operation. On the internal portion of the arc nozzle 46 may be disposed a corrugated or ridged region 50 which provides high arc tracking resistance during the circuit breaker opening operation.

There is provided a first gas pressure region 52 which may exist between the seals 32 and the combined seals 44 and 48. Gas pressure is built up in the region 52 during a circuit breaker opening operation as will be described more fully hereinafter. A second gas pressure region 53 may exist between the left end of the circuit breaker apparatus 10 and the combined seals 44 and 48. Openings 51 disposed in the cooling tube TU1 provide paths of communication between the latter region 53 and the internal portion of the hollow conductor 18. A third gas pressure region may exist in the right portion of the circuit breaker apparatus between the seal 32 and the right side of the circuit breaker apparatus 10. The previously described opening 43 provides a path of gas communication between the internal portion of the hollow conducting tube 36 and the region 54. All of the latter described gas pressure regions contain gas of relatively different pressure during certain portions of the operating cycle of the circuit breaker 10. The pressure in each case is related to the relative sizes of openings 51 and 43 for example. The relative gas pressures in the latter-named regions 52, 53 and 54 during opening and closing of the circuit breaker apparatus provide the puffer action which will be described hereinafter. There is provided in the conducting flange 38 an opening 56 which communicates with the previously described region 52 and with the internal portions of both of the hollow conducting members 18 and 36. The communicating path previously described is conveniently located such that the contact fingers 40 and the contact piece 19 are disposed therein during a circuit breaker opening or closing operation. The previously described flexible fingers 28 provide a path of electrical conduction between the movable hollow conductive tube 36 and the internal conductor 26. A source of electrical power S may be serially or otherwise connected with a load LD which is to be protected by the circuit breaker apparatus 10. Such an arrangement is shown schematically in FIG. 1. The serial arrangement is interconnected with the terminal 14 and the terminal 24. Cooling tube TU1 encloses a cooling mesh M1 through which hot gas following path 62 may exhaust radially into region 53 by way of openings 51. Likewise, cooling tube TU2 encloses a cooling mesh M2 through which hot gas following path 60 may be diffused laterally by way of opening 43. In the latter case, a deflector 22*a* is positioned on rod 22 to aid in channeling a portion of the gas in path 60 into the mesh M2 for lateral diffusion therethrough.

OPERATION OF THE PUFFER CIRCUIT BREAKER APPARATUS 10

During the closing operation of the circuit breaker apparatus 10, the connecting rod 22 forces the hollow conducting tube 36 to the left as viewed in FIG. 1. Electrical continuity is maintained between the terminals 24 and the moving conducting cylinder 36 by way of the internal conductor or connector 26 and the fingers 28. As the cylinder 36 moves to the left, the flange 38, the nozzle 46 and the contact fingers 40 also move to the left. The movement of the flange 38 to the left causes the volume of the region 52 to enlarge, thus creating a local short term pressure differential between region 52 and regions 53 and 54 such that gas from region 54 moves through valve 30 by way of a channel 55 along the path 72 to region 52. Gas from regions 53 and 54 may move into region 52 by way of opening 56 until portion 41 of fingers 40 overlaps contact 19 thus closing off orifice 56 from regions 53 and 54. This charges region 52 with puffer gas ($SF_6$ for example) during the circuit breaker closing operation, it being understood that the unidirectional valve 30 opens to pass gas only in the direction 72 and closes to prevent gas from passing therethrough in the opposite direction. As the movable contact assembly 34 continues movement to the left, a position is reached where the contact fingers 40 make electrical contact with the contact piece 19 on the hollow conductor 18. A short time thereafter the extended contact region 39 makes electrical contact with the main contact fingers 20. In this position the circuit which includes the load LD and the source S is closed through the puffer circuit breaker 10.

In a contact opening operation the contact rod 22 moves in the direction 57, thus causing the hollow conductive tube 36 of the movable contact assembly 34 to move to the right. The main contact fingers 20 and the extended contact region 39 of the conducting flange 38 disengage first. Movement of the flange 38 and nozzle 46 in the direction 57 through the distance D forces the trapped gas in the region 52 to become pressured by the reduction in volume in region 52. The latter movement through the region D is sometimes referred to as "lost motion" movement. Eventually a point is reached during the contact opening cycle where the contact piece 19 of the generally stationary hollow conductor 18 and the contact fingers 40 of the movable contact assembly 34 disengage under load or overload current or the like, thus generating an arc A. The pressurized gas in region 52 follows path 58 through opening 56 and is puffed or forced into the region of the arc A for quenching and cooling the arc A and for blowing the arc A out from between the contact piece 19 and the contact fingers 40. The heated gas may then follow path 62 into the hollow conductor 18, radially through the cooling mesh M1, through the openings 51 of the tube TU1 and into the region 53. Alternatively or concurrently, the heated gas may follow the path 60 through the internal portion of the cylinder 36 and out through the holes 43 to be diffused laterally of the center line CL through the mesh M2 and into the region 54. The relationship between the diameter of the orifice through the contact 19, the internal diameter of the tube 12, and the velocity of the piston 38 are chosen so that the volume of space 53 increases appreciably faster than gas can flow into the space through the central orifice of the contact piece 19. The result is a reduction in gas pressure in the space 53 and an increase in the pressure drop across the central orifice of the contact 19, which increases interrupting ability.

After the arc A has been extinguished, the movable contact assembly 34 continues movement to the right in the direction 57 until a stable opened position is reached. The puffer circuit breaker apparatus 10 is in this position ready for a closing or reclosing operation. At this time, the pressure in the three gas regions 52, 53, 54 become equalized if such has not occurred earlier in the opening cycle. It is to be noted with respect to the arc A that the opening 56 in the conducting flange 38 provide a path whereby the arc current A may impinge upon the inner surface of the insulating support tube 12. In a like manner, the heat of the arc A may follow the same path and raise the temperature of the inner surface of the insulating support tube 12. Furthermore, the arc products produced by the interaction of sulfur hexafluoride gas for example and the electrical arc A may contact the inner surface of the insulating support member 12. These arc products may be carried along the path 62 or along the path 60 to the regions 53 and 54, respectively. The latter regions are adjacent to the inner surface of the insulating support tube 12. It is to be noted that direct radial exposure of the inner wall of tube 12 to arc A is prevented by the presence of the cone 46. In a like manner, since the gases are likely to be hot, the residual heat of the arc A even after cooling by the cooling meshes M1 and M2 may raise the temperature in the regions 53 and 54. It is also to be understood that the pressure of the accumulated gas within the interior of the insulating support tube 12 may increase, at least for a short time, during the arcing process because of the presence of the arc products, for example. It is therefore desirous that the insulating support tube be relatively unaffected by the direct impingement of electrical current such as may exist in the arc A or by the presence of arc products or by the presence of the heat of the arc or by the presence of relatively high pressure gas for at least a short period of time.

Because of the unitary, i.e. single shell concept, the insulating support tube 12 must not only support most of the portions of the circuit breaker apparatus 10, but must also act as an electrical insulator between terminals 24 and 14. The tube 12 must also act as a gas containing vessel heat shield and corrosion resistive vessel. Generally, it has been found that if the inner wall of the insulating support tube 12 becomes carbonized, blistering and flaking of the inner wall surface interferes with the mechanical functions of the interrupter, which of course is undesirable. It has been found that a fiberglass tube alone will not resist carbonizing and the well-known tracking phenomenon associated therewith. It has been found that the use of a thin polytetrafluoroethylene (TFE) liner for a fiberglass main tube body resists tracking in the presence of the electrical arc, resists decomposition under the heat of the electrical arc, and resists decomposition under the influence of the arc products of the electrical arc. In addition, the substantial outer fiberglass support body resists rupture under the presence of the pressure of the various gases which are present either before or after the arcing operation.

It has been found that fluorinated polymers or fluoroplastic materials such as TFE work well in the previously described circuit breaker apparatus. TFE lined tubes are constructed by first coating a steel mandrel with either of two resin systems which will be discussed hereinafter. At this point a five mil (0.005 in.) TFE film, such as may be sold under the trademark CHEMPLAST, may be utilized. The film is etched on both sides to permit resin bonding. A sodium based etching solution may be used for the etching purpose. The etched thin film is wound on the wet mandrel employing, for example, a 50% overlap to provide a two-ply liner. While the film is being wound, it is also being continuously coated with one of the two resin systems to be discussed hereinafter. The resin systems act as a bonding agent between the plies. In the preferred embodiment of the invention the total thickness of the completed liner is 0.010 inch.

Figure 2:
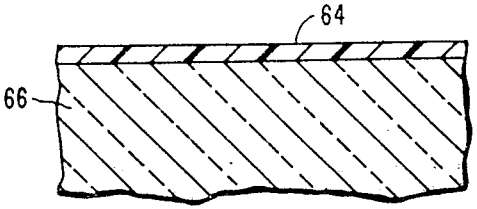

By referring to FIG. 2, in addition to FIG. 1, it can be seen that the relatively thin layer of TFE film 64 forms the inner liner for the insulating support tube 12. The remaining portion 66 (not shown to its full dimension relative to the thin film 64 in FIG. 2) may comprise type 30-E glass which is filament wound. The glass roving is wet wound using one of the previously described resins over the TFE liner. A 60° helical winding pattern may be used in a preferred embodiment of the invention. The layers of glass are built up until a wall thickness of 7/16 of an inch is achieved in a preferred embodiment of the invention. At this point the tube is gelled and cured, then after cooling, stripped from the winding mandrel.

As was mentioned previously, two resin systems have been found for use with the TFE lined, filament wound tube previously discussed. One of the resins is sold under the trademark DER 330. It is a bisphenol-A/epichlorohydrin base epoxy resin. Its desirable characteristics include hardness, toughness, and resistance to chemical attack. It also possesses high tensile and compressive strength, good chemical properties, and it adheres tenaciously to most materials including etched TFE. It is also favorably suited to structural laminates, such as filament wound pipes and vessels. The formulation and cure schedule is shown below:

DER 330—70 parts by weight
Diglycidylether of Neopentyl Glycol (DGENP-G)—30 parts by weight
p,p'-Methylenedianiline (MDA)—27 parts by weight
Gel 2 hours at 175° F.
Cure 2 hours at 212° F. plus 4 hours at 300° F.

Another resin system which was found to be useful is sold under the trademark CY-179. This is a general purpose cycloaliphatic-diepoxide. When anhydride cured it features good electrical loss properties, arc and track resistance, and high heat deflection temperature. Another very desirable feature is its good resistance to weathering. Even if the puffer interrupter is not to be protected from weather, in some instances dust and moisture may deposit on the outside surface of the single insulating tube 12 and electrical flashover between electrodes 24 and 14, for example, may occur. In these cases the cycloaliphatic resin is a distinct advantage because of its superior non-tracking performance. Formulation and cure schedules follow:

CY 179—100 parts by weight
Hexahydrophthalic Anhydride (HHPA)—105 parts by weight
Accelerator 065 (Ciba-Geigy)—12 parts by weight
Gel 2 hours at 175° F.
Cure 4 hours at 300° F.

The TFE lining, polytetrafluoroethylene, plays a number of important functions in the interrupter 10. The thermal stability of TFE is well known. The polymer does not melt, but rather cold flows at 620° F. and can be used continuously at 500° F. Short time exposure to temperatures higher than 700° F. can be tolerated without the occurrence of carbonization. TFE has good arc resistance qualities. Carbon tracks are not formed. The surface friction of TFE is low and its static friction is lower than its dynamic friction. This is useful because the piston, i.e. seal 44, of the puffer rides against the inner wall of the tube 12. The latter piston comprises the conducting flange 38 with its seal 44. The products of arced sulfur hexafluoride do not react with TFE.

It is to be understood with respect to the embodiment of the invention that the relative thin lining of the tube 12 may be larger or smaller than 10/1000 inch as was cited in the illustrative example. The relatively thin film is necessary as a protective coating for the inner surface of the insulating support tube 12. It is also to be understood that the cylindrical relationships of the elements is not necessary. The tube 12 may be non-cylindrical or even angular in cross-section in other embodiments of the invention. It is also to be understood that the basic operating characteristics of the circuit breaker are not limiting except to the extent that the single tube is utilized in close proximity to an arc, or to the heat of the arc, or the products or the arc, or the pressure caused by the arc in the presence of gas. It is also to be understood that the arrangement of the terminals of the apparatus is not limiting. It is to be understood that the cooling materials M1 and M2 may comprise wound copper mesh, but arc is not limited thereto in either material of geometry.

The apparatus taught with respect to the embodiments of this invention has many advantages. One advantage lies in the fact that a single barrel may be used in a puffer circuit breaker apparatus, thus reducing the radial size of the circuit breaker apparatus and the amount of construction material necessary to form the apparatus. Furthermore, the utilization of an overlapping contact arrangement with a nozzle which is permanently radially disposed between the contact region and the inner wall of the barrel provides increased gas pressure and increased protection during the circuit breaker opening operation.

What we claim as our invention is:

1. A puffer circuit interrupter comprising:

(a) insulating tube means having first and second spaced external terminal means thereon, said external terminal means communicating with the internal portion of said tube means;

(b) first electrical contact means disposed within said tube means in electrical contact with said first external terminal means;

(c) second electrical contact means disposed within said tube means in electrical contact with said second external terminal means, said second contact means being movable into and out of a disposition of electrical engagement with said first contact means;

(d) piston means fixedly disposed upon said second contact means for moving therewith and slidably disposed in gas seal relationship against the inner wall of said insulating tube means for longitudinally moving thereagainst, said piston means having an opening therein which communicates with an arc region between said first and second contact means, puffer gas which resides between said inner wall of said tube means and the outer portion of said second contact means being forced to flow by the movement of said piston means through said opening into said arc region as said second contact means disengages from said first contact means to affect an arc between said first and second contact means; and (e) nozzle means fixedly disposed upon said piston means radially outboard of said opening therein and movably disposed upon said first contact means at all times, said nozzle means at all times being radially interposed between said arc region and said insulating tube means to protect said insulating tube means from direct radial arc effects.

2. The combination as claimed in claim 1 wherein said first and second electrical contact means are hollow, said puffer gas exiting generally exclusively through both said first and said second contact means after flowing into said arc region.

3. The combination as claimed in claim 2 wherein said insulating tube means has a circular inner periphery of a first predetermined diameter, said first hollow contact means has a circular inner periphery of a second predetermined diameter, and said piston means is movable at a predetermined velocity, the relationship between said first diameter, said second diameter and said velocity being such that the puffer gas pressure in the region of said arc is increased as said piston means moves in a given direction.

4. A puffer circuit interrupter, comprising:

(a) insulating tube means having first and second spaced external electrical terminal means thereon, said external terminal means communicating with the internal portion of said tube means;

(b) first electrical contact means disposed within said tube means in electrical contact with said first external terminal means;

(c) second electrical contact means which is hollow and which is disposed within said tube means in electrical contact with said second external terminal means, said second contact means being movable into and out of a disposition of overlapping electrical contact with said first contact means through a fixed overlap region; and (d) piston means fixedly disposed upon said second contact means for moving therewith and slidably disposed in gas seal relationship against the inner wall of said insulating tube means for longitudinally moving thereagainst, said piston means having a shielded opening therein which communicates with an arc region between said first and second contact means when said contact means are not in said fixed overlap region, puffer gas which resides between the inner wall of said tube means and the outer wall of said second contact means being compressed during the period in which said piston is being moved to take said second contact means out of contact with said first contact means but while both said latter contact means are in said overlap region, said compressed puffer gas then flowing through said opening into said arc region as said second contact means moves to an open disposition to affect an arc between said first and second contact means while nevertheless protecting said insulating tube means from direct radial arc effects.

5. The combination as claimed in claim 4 wherein said first electrical contact means is hollow, said puffer gas exiting generally exclusively through both said first and said second contact means after flowing into said arc region.

6. The combination as claimed in claim 5 wherein said insulating tube means has a circular inner periphery of a first predetermined diameter, said first hollow contact means has a circular inner periphery of a second predetermined diameter, and said piston means is movable at a predetermined velocity, the relationship between said first diameter, said second diameter and said velocity being such that the puffer gas pressure in the region of said arc is increased as said piston means moves in a given direction.

* * * * *